United States Patent [19]

Kunze et al.

[11] Patent Number: 5,064,148

[45] Date of Patent: Nov. 12, 1991

[54] NAVIGABLE FLAT KITE

[76] Inventors: Christian Kunze, Wieteralles 33, 3410 Northeim; Till Habermann, Weenderlandstrasse 86, 3400 Göttingen, both of Fed. Rep. of Germany

[21] Appl. No.: 534,634

[22] Filed: Jun. 6, 1990

[30] Foreign Application Priority Data

Jun. 6, 1989 [DE] Fed. Rep. of Germany ... 8906900[U]
Mar. 7, 1990 [DE] Fed. Rep. of Germany ..... 4007159

[51] Int. Cl.[5] ..... B64C 31/06
[52] U.S. Cl. ..... 244/153 R; 244/155 A
[58] Field of Search ..... 244/153 A, 153 R, 155 A

[56] References Cited

U.S. PATENT DOCUMENTS

| | | | |
|---|---|---|---|
| 2,437,038 | 3/1948 | Nowka | 244/153 R |
| 3,074,673 | 1/1963 | Williams | 244/153 R |
| 3,296,617 | 1/1967 | Rogallo | 244/153 R X |
| 3,358,399 | 12/1967 | Waldmann | 244/153 R X |
| 3,409,255 | 11/1968 | Sada | 244/155 R |
| 3,967,798 | 7/1976 | Christoffel, Jr. | 244/153 R |
| 4,186,680 | 2/1980 | Harpole | 244/153 R X |
| 4,892,272 | 1/1990 | Hadzicki | 244/153 R |
| 4,958,787 | 9/1990 | Sterling | 244/153 R |

FOREIGN PATENT DOCUMENTS

| | | | |
|---|---|---|---|
| 3830459 | 3/1989 | Fed. Rep. of Germany | 244/153 R |

*Primary Examiner*—Joseph F. Peters, Jr.
*Assistant Examiner*—Carla Mattix
*Attorney, Agent, or Firm*—Herbert Dubno

[57] ABSTRACT

A navigable flat kite is described which has a linkage comprising cross bars and longitudinal bars, a sail mounted to the linkage and a balance mounted to the sail and/or the linkage and adapted to be connected with at least one navigation line. The kite consists of at least two individual kites which are connected by means of their cross bars such that the individual kites are adapted to be turned relative to one another around the cross bars as axis of rotation. The two individual kites have a sail surface with identical dimensions. Each individual kite is associated with at least one balance including at least one balance line which is mounted to the sail and/or the longitudinal bars above or below the cross bars.

19 Claims, 1 Drawing Sheet

NAVIGABLE FLAT KITE

FIELD OF THE INVENTION

The present invention is directed to a navigable flat kite having a linkage with cross bars and longitudinal bars, a sail mounted to the linkage and a balance mounted to the sail and/or the linkage and adapted to be connected with at least one navigation line.

BACKGROUND OF THE INVENTION

Navigable flat kites are known in a plurality of embodiments which are, for instance, different in shape. As common features these flat kites have a cross bar and a longitudinal bar which form a linkage for the sail which is normally designated as a cover or as coverage. According to the known flat kites a balance having two, three, four or more legs is fixed to this sail and/or the linkage. A navigation line is connected to the balance so that the user can transfer the tensile load necessary for the navigation of the kite by means of the navigation line onto the legs of the balance. Thus the flight attitude of the kite is changed and thus the desired navigation movement of the kite is attained by increasing or decreasing the wind resistance.

Accordingly, the known kites described above carry out any change of direction only in an arcuate flight line, i.e. when the direction is changed the kite always flies in a curved line which is more or less curved from the original position to the new position. This change of direction caused by a turning of the kite results often in a deterioration of the flight stability of the kite so that the kite begins to spin. Furthermore, such a kite cannot be braked during the flight and especially during a change of the flight direction so that altogether the navigation possibilities of the known flat kites which are desired by the user are restricted.

OBJECT OF THE INVENTION

It is the object of the present invention to provide a kite of the cited kind which has an especially wide variety of navigation possibilities.

According to the invention this object is attained by a kite which is formed of at least two individual kites which are connected by means of their cross bars such that the individual kites are turnable relative to one another around the cross bars as axes of rotation. The individual kites have sail surfaces of the same size. Each individual kite is associated with at least one balance comprising at least one balance line which is fastened to the sail and/or to the longitudinal bar above or below the cross bars.

According to the invention, a navigable flat kite is provided which comprises a linkage including cross bars and longitudinal bars, a sail fixed to the linkage and a balance mounted to the sail and/or to the linkage, the balance having at least one navigation line which can be mounted thereto. The kite is formed by at least two individual kites which are connected by means of their cross bars such that the individual kites are rotatable with respect to one another around the cross bars as rotation axes. Furthermore, the individual kites have an identical sail surface area. Each individual kite has associated therewith at least one balance comprising at least two balance lines so that such a balance can be also designated as a balance with two legs. At least one balance line of the balance of each individual kite is fastened to the sail and/or the longitudinal bar above and below the cross bar.

In other words, the inventive flat kite has at least two individual kites which are connected with one another and which are adapted to be rotated relative to one another around their connection axis. The individual kites have sail surfaces of the same size. They are individually navigated by means of at least one balance and a navigation line associated therewith so that the position of the individual kites can be individually adjusted with regard to the wind.

The inventive kite has a number of advantages. Compared with a single kite, it is characterized by a high flight stability which can be significantly recognized when the direction is changed. This depends on the fact that it is not necessary with the inventive kite to turn the whole kite when the direction is changed. According to the simplest embodiment of the inventive kite which consists of two individual kite members, the position of one individual kite members is rather changed with respect to the wind while the other individual kite remains in its original position. As a result the total resistance of the kite is unilaterally changed, i.e. the resistance on the side of the individual kite member whose position has been changed is enlarged or decreased in response to the caused change of position. This, however, has the result that the kite changes its flight direction in response to the dimension of the caused change of position of the individual kite so that it is possible with the inventive kite to change position between 1° and 360° with respect to the original flight direction. However, since with such a change of direction normally the position of the other individual kite member is not changed, the flight stability and controllability of the kite will be maintained. Furthermore, with the inventive kite it is possible to abruptly brake the kite during its flight without causing an undesired rapid fall of the kite. On account of the above-described design of the inventive kite, the same can fly in all directions with the same speed in a flight-stable position. For this, it is only necessary to adjust the position of the individual kites relative to one another with respect to the corresponding wind conditions.

Such embodiments of the inventive flat kite according to which the individual kites are additionally identically formed have especially good flight and navigation characteristics. So, it is for instance possible to provide these individual kites with a circular, elliptical, polygonal or triangular sail. However, with regard to the navigation ability such kites are especially suited of which the individual kites have rectangular and especially square sails.

As already mentioned above, the simplest embodiment of the inventive kite consists of two individual kites. Of course, it is also possible to provide more than two individual kites or kite members, for instance three, four, five or six individual kites. However, with increasing numbers of individual kites it can become necessary that these kites have to be handled simultaneously by several persons.

Advantageously, the kite assembly consists of two individual kites which are each covered with a rectangular or square sail. In addition to the above-described connection of the two individual kites by means of their cross bars, the two sails of the individual kites are connected in the region of their corners. In the simplest case this connection is realized by sewing or adhering the corresponding overlapping corner points of the sail with one another. It is also possible to connect these corner points by means of mechanical fastening means, as for instance press buttons, zippers or barr straps. The stability of the kite is increased by this additional connection of the sails through the corner points so that for instance a fluttering during the flight is avoided. This additional connection can be also formed such that the turning capacity of the individual kites relative to one another around their cross bars as rotation axis is limited so that even unskilled users cannot overnavigate such a kite and cannot bring the same into a flight-instable position.

There are several possibilities in order to attain the above-described turning of the individual kites relative to one another. So, for instance, the cross bars can be connected by means of a corresponding plug-type connection with formation of a common cross bar. Of course, the plug-type connection has to be designed such that the free turnability of the individual kites relative to one another is not impeded hereby. In the simplest case, this is assured by the feature that the cross bar of the first individual kite has a guide sleeve in the region of its connection portion with the cross bar of the next kite. The corresponding portion of the cross bar of the next kite is inserted into this guide sleeve. The guide sleeve has such a diameter that the cross bar of the next kite is freely rotatable therein.

According to another embodiment of the inventive flat kite the cross bars are formed as an integral cross bar on which the sails of the individual kites are freely rotatably mounted at this common cross bar. For instance, this can be realized by suitable fastening means, as for instance loops, eyelets etc., through which the cross bar extends are provided to hold the sails on the cross bar.

Advantageously, the common integral cross bar or the connected cross bars of the individual kites are located in correspondingly shaped pockets which are provided in the respective sail of the individual kites. These pockets have the effect that the sails of the individual kites are rotatable with respect to one another around the cross bar or the cross bars as axes of rotation without the danger that the cross bars will slide off the sails. The pocket can be provided not only with one aperture but also with two end-sided apertures. In the latter case it is necessary to fix the sails with their ends at the corresponding portion of the cross bar or the cross bars which can be achieved in an especially good manner by corresponding resilient fastening means as is described below.

In order to achieve the necessary tension of the sails of the individual kites with the inventive kite, each individual kite has at least one longitudinal bar which is located as a function of the shape of the sail. With a rectangular or square sail it is advantageous to provide a longitudinal bar having an angle of about 90° with respect to the cross bar. Of course, if necessary, more than one longitudinal bar can be provided as is also known with for individual kites.

If the individual kites of the assembly have square or rectangular sails it is advantageous that the longitudinal bar extends between the opposite corner points of the rectangular or square sail with each individual kite. Such a longitudinal bar has preferably an angle of 90° with respect to the cross bar. By this, it is assured that the sail is tensioned over its entire surface.

In order to tension the sail by means of the cross bars and longitudinal bars and to connect the sail with the same, a further embodiment of the kite assembly of the invention has resilient fastening means which are located at the ends of the cross bars and longitudinal bars, respectively, and which are mounted to the sail, respectively. These resilient fastening means allow the above-described turning of the individual kites relative to one another without resulting in a damaging of the sails. In the simplest case, these fastening means are resilient strings. One can achieve an especially firm fixation of the sail at the end portions of the longitudinal bars and cross bars by using loop-like resilient fastening means which, for instance, are mounted to the sail by means of an eyelet or a loop and by means of a metallic ring at the end portion of the longitudinal bars and cross bars, respectively.

An embodiment of the inventive kite according to which each rectangular or square individual kite has two balances with three legs can be navigated especially well. With each individual kite the longitudinal bar and the cross bar are arranged in a cross-like manner and extend between the corner points of the sail. In addition to the common longitudinal bar the two individual kites are connected by means of a corner point. According to this embodiment of the inventive kite the two balances of each individual kite are arranged such that two balance lines of each balance are mounted at the end of the cross bar and of the longitudinal bar to the sail or at the end portions of the cross bars and longitudinal bars, respectively, while the respective third balance line of each balance is fixed in the region of that corner point at which the two individual kites are connected with one another.

In order to further improve the above-described embodiment of the inventive kite there is still the possibility to connect the two balances of each individual kite by means of a balance line which has the result of further improving the ability of navigation of the kite.

In principle, the linkage of the inventive kite can be made of any material having a sufficiently high strength. So, for instance, it is possible to use wooden or metallic bars as material for the linkage. Plastic bars, however, have the best characteristics with regard to low weight and a high strength.

As the sail the inventive kite can have either a paper coverage with high strength, a coverage of plastic foil or especially a coverage of a textile fabric. Such a textile fabric is either very densely made or provided with a corresponding coating so that it is also wind-tight.

Especially good flight characteristics of the inventive kite can be achieved with a sail having approximately the same stretching characteristics in longitudinal direction and transversely. This can be achieved for instance by selecting a textile fabric as sail which has the same or approximately the same stretching characteristics in warp and weft direction. This can be especially achieved by using a fabric having densities warp and weft density.

It is especially advantageous if the sail is selected such that an angle $\alpha$ of between 10° and 30°, preferably of between 12° and 15°, is formed upon wind pressure.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
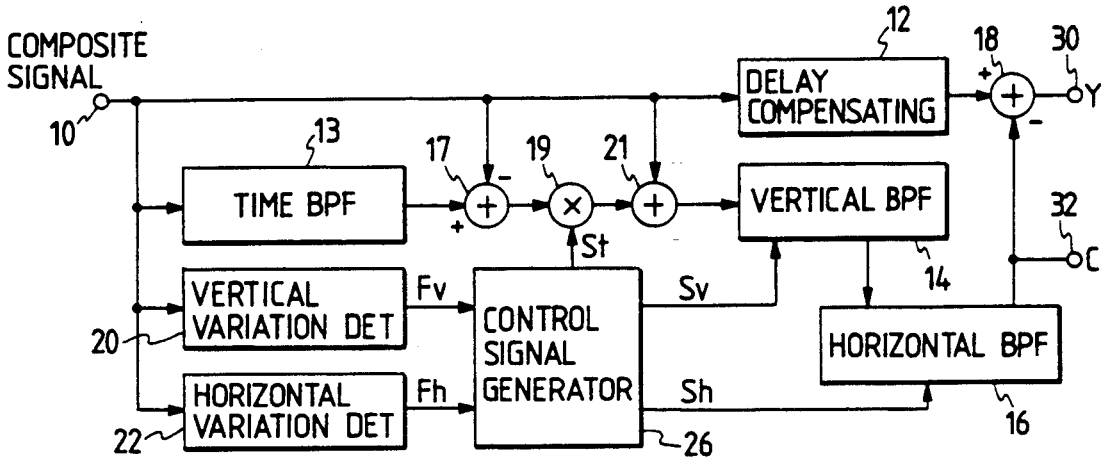
FIG. 1 is a schematic top view of an embodiment of the kite assembly according to the invention.

The kite assembly 1 shown in FIG. 1 has two individual kites 2 and 3. The individual kites 2, 3 are connected by means of their cross bars 4 and 5 such that the individual kites 2 and 3 are rotatable with respect to one another in the direction of the arrows 6 and 7 around their cross bars 4 and 5 as axes of rotation. In order to achieve this effect, the two cross bars are located in a pocket which is open at both ends and which extends over the total length of the cross bars 4 and 5. In addition to the cross bars 4 and 5 each individual kite 2 and 3 has a longitudinal bar 8 and 9 by which the sails 10 and 11 of the individual kites are tension. In addition to their connection by means of the cross bars the two individual kites 2 and 3 are also connected in the region of one corner point 12 such that the corresponding regions of this corner point overlap. In such embodiments according to which the sails 10 and 11 consist of a textile fabric, this additional connection is achieved by sewing the sails together at their additional connection region 12.

Each individual kite 2 and 3 has two balances 13 and 14 with three legs, the balance only being shown for the kite 2. Two balance lines 13*a* and 13*b* extend to the end portions 1*b* and 16 or 16 and 17 of the square sail 11 while the respective third balance line 13*c* or 14*c* is mounted to the connection region 12. An adjustable eyelet 18 or 19 is located at the end portion of the balances 13 and 14, respectively. A navigation line 20 or 21 leading to the user of the kite will be mounted to these eyelets. The eyelets 18 and 19 are connected with one another by means of a balance line 23.

The actuation of the navigation lines 20 and 21 and the shifting of the balances 13 and 14 or the corresponding balances of the kite 3 which are not shown has the effect that the individual kites 2 and 3 are turned with respect to one another in the direction of the arrow 6 or 7. This, however, has the effect that the wind resistance of the complete kite can be changed regionally so that the kite 1 can fly in each new direction in a flight-stable manner. The kite 1 can be also stopped in every flight phase and can be navigated into another direction, for instance into the opposite direction.

Figure 2:
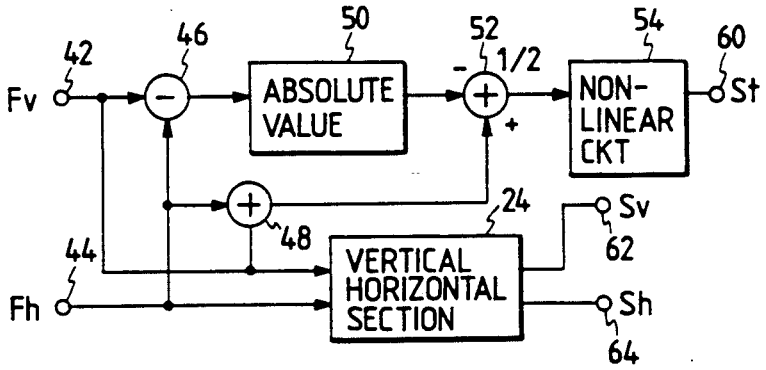
FIG. 2 is a detail view of the connection of the cross bars.

In FIG. 2 an embodiment of the connection of the cross bars 4 and 5 is shown in detail. The cross bar 5 has a guide sleeve 30 surrounding the cross bar 4 in its end portion and holding the same in a rotatable manner. In order to achieve this, the guide sleeve 30 has a diameter d1 which is slightly larger than the diameter d2 of the cross bar 4 so that the cross bar 4 can be rotated within the guide sleeve 30 in the direction of the arrow 6 or vice versa.

Figure 3:
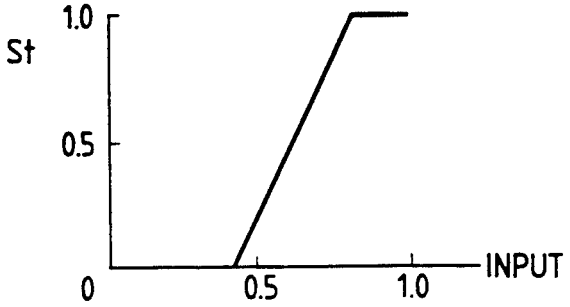
FIG. 3 is a detail view of the attachment of the corner point of the sail at the end portion of the cross bar or the longitudinal bar.
Figure 1:
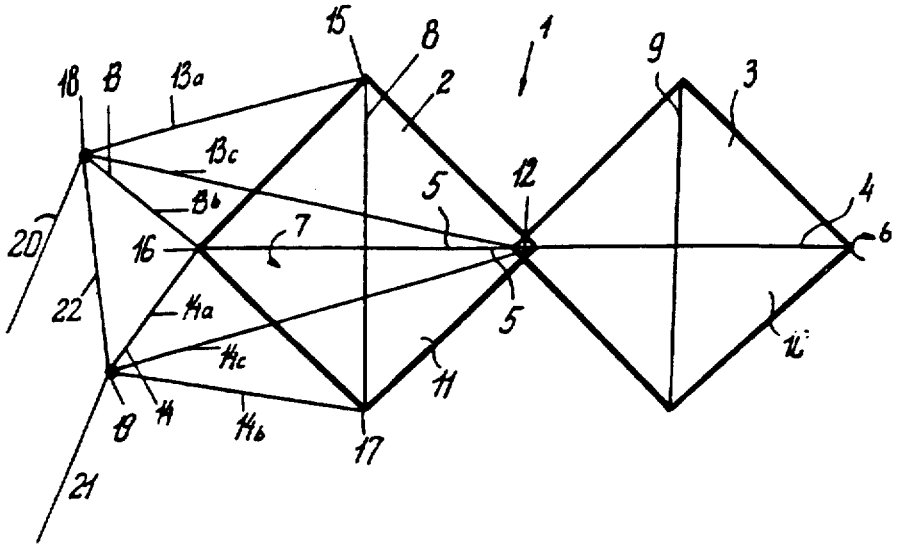
Figure 2:
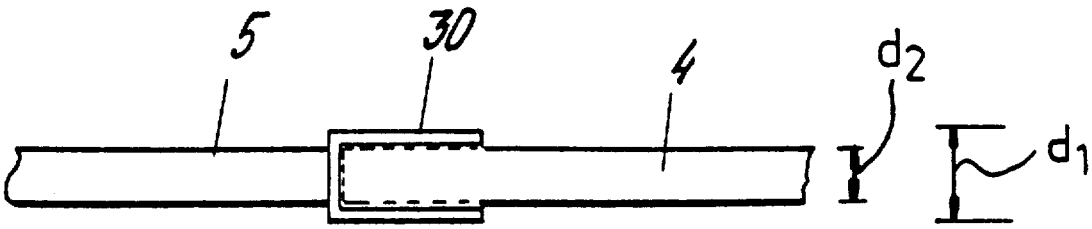
Figure 3:
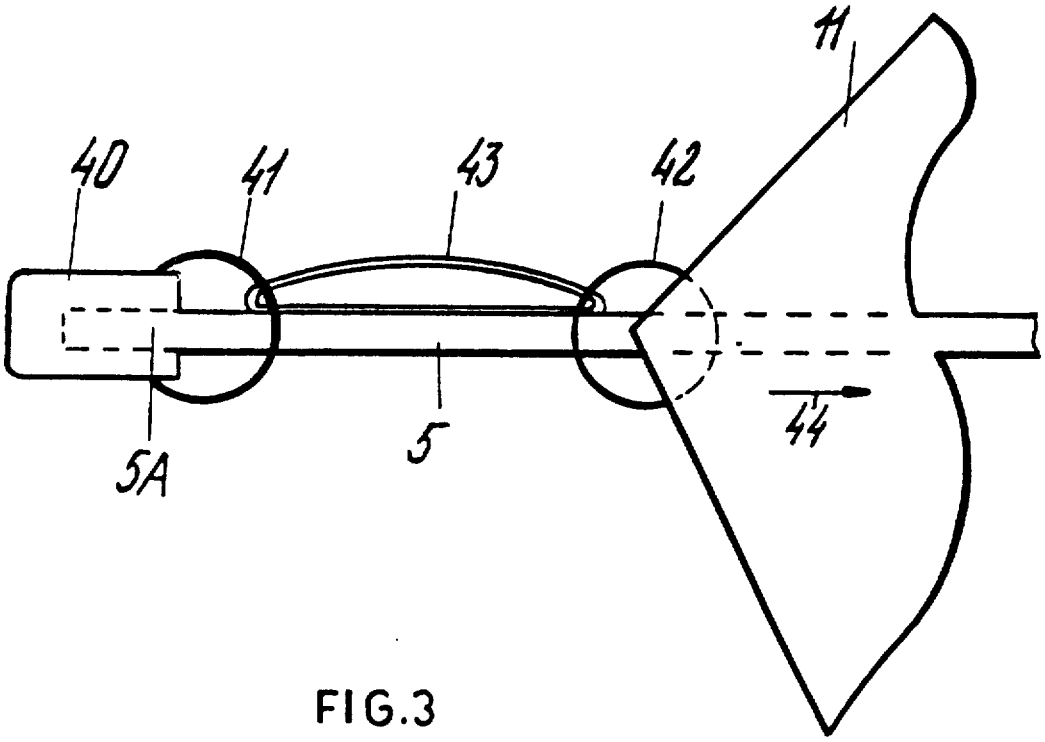

FIG. 3 shows in a further detail view an embodiment of the mounting of the sail at the linkage, for instance at the suction of the above-described cross bars 4 or 5 or at the longitudinal bars 8 or 9 or by means of an end portion 5A of the cross bar 5. This end portion 5A of the cross bar 5 has a cap-like sleeve member 40 which is held on the end portion 5A of the cross bar 5 by clamping engagement. A ring 41, for instance an O-ring of metal, is mounted on the cap-like sleeve member 40. The sail 11 has also a suitable fastening member 42 in its corresponding corner point. This fastening member 42 can be a textile fabric loop or also an O-ring. An endless resilient fastening member 43 extends between the ring 41 and the fastening member 42. The resilient fastening member 43 assures that the sail has always the necessary tension so that it is tensioned and furthermore can be moved in the direction of the arrow 44 or vice versa so that a rotation of the individual kites relative to one another cannot result in a damaging of the sail.

According to a further embodiment of the inventive flat kite the sail has a portion which is air-pervious. By this, it is achieved that according to this embodiment of the kite the wind pressure onto the kite sail is reduced so that such a kite can be correctly handled even with high wind forces. Furthermore, this air-pervious portion has the effect that kites having a correspondingly large sail surface can be still navigated without the necessity that the corresponding user has to level off extreme tensile forces which are transfered to the user from the kite through the balance and the navigation line. Especially with kite assemblies consisting of a plurality of individual kites, for instance of four up to eight individual kites, it is necessary to provide several air-pervious portions on account of the relatively large sail surface due to the above-cited grounds. These air-pervious portions are preferably symmetrically located in each sail surface of the individual kite.

We claim:

1. A navigable flat kite assembly, comprising:

at least two individual planar kites, each of said kites having:

a crossbar, a longitudinal bar extending crosswise to said crossbar, a sail mounted on said crossbar and said longitudinal bar, the sails of said kites being of the same shape and area, and at least one respective balance individual to the respective kite and having balance lines connected to the respective kite on at least one side of the respective crossbar, at least one of said sails of one of said kites being individually pivotable about a pivot axis defined by the respective crossbar with respect to another of said kites;

linkage means for interconnecting said crossbars of said kites so that said kites can lie in a plane; and navigation lines connected to said assembly for controlling flying thereof, said navigation lines including at least one of said navigation lines being connected to the balance of said one of said kites for turning said one of said kites about said axis relative to said other of said kites.

2. The kite assembly defined in claim 1 wherein said assembly consists of two of said kites.

3. The kite assembly defined in claim 1 wherein said sails are rectangular and are interconnected at one corner of each of said sails.

4. The kite assembly defined in claim 1 wherein said linkage means includes a sleeve on one of said crossbars receiving the other of said crossbars with a plug connection.

5. The kite assembly defined in claim 1 wherein said crossbars are unitary with one another at a junction between them forming said linkage means and form a single bar, said sails being mounted so as to pivot about said single bar.

6. The kite assembly defined in claim 1 wherein the crossbars are received in pockets provided in said sails and enabling rotation of said sails about said crossbars.

7. The kite assembly defined in claim 6 wherein said sails are rectangular and said pockets extend along diagonals of said sails to receive said crossbars and said longitudinal bars.

8. The kite assembly defined in claim 7 wherein said pockets have apertures at both opposite ends thereof.

9. The kite assembly defined in claim 1 wherein said crossbars are at angles of about 90° with respect to the respective longitudinal bars.

10. The kite assembly defined in claim 9 wherein said sails are rectangular and said longitudinal bars extend between diagonally opposite corners of said sails.

11. The kite assembly defined in claim 1, further comprising resilient means for connecting each of said crossbars and said longitudinal bars to the respective sails at ends thereof.

12. The kite assembly defined in claim 1 wherein said sails are textile fabric.

13. The kite assembly defined in claim 12 wherein said textile fabric has the same stretchability in warp and weft directions.

14. The kite assembly defined in claim 13 wherein the textile fabrics of said sails have the same warp and weft densities.

15. The kite assembly defined in claim 1 wherein said sail forms an angle of attack of 10° to 30° upon encountering wind pressure.

16. The kite assembly defined in claim 1 wherein said sail is made of a material with low stretchability.

17. The kite assembly defined in claim 1 wherein each of said sails has at least one air-pervious portion.

18. A navigable flat kite assembly, comprising:

at least two individual planar kites, each of said kites having:

a crossbar, a longitudinal bar extending crosswise to said crossbar, a sail mounted on said crossbar and said longitudinal bar, the sails of said kites being of the same shape and area, and two balances with three legs individual to the respective kite and each balance having two balance lines connected to the respective kite at one end of the respective crossbar and at one end of a respective longitudinal bar and a third balance line connected to a region at which said kites are interconnected at respective corners, at least one of said sails of one of said kites being individually pivotable about a pivot axis defined by the respective crossbar with respect to another of said kites;

linkage means for interconnecting said crossbars of said kites so that said kites can lie in a plane; and navigation lines connected to said assembly for controlling flying thereof, said navigation lines including at least one of said navigation lines being connected to one of the balances of said one of said kites for turning said one of said kites about said axis relative to said other of said kites.

19. The kite assembly defined in claim 18, further comprising a respective balance string connecting the two balances of each kite.

* * * * *

UNITED STATES PATENT AND TRADEMARK OFFICE

CERTIFICATE OF CORRECTION

PATENT NO. : 5,064,148

DATED : November 12, 1991

INVENTOR(S) : Christian Kunze, et al

It is certified that error appears in the above-identified patent and that said Letters Patent is hereby corrected as shown below:

The title page, should be deleted to be replaced with the attached title page.

The drawing sheet, consisting of Figs. 1-3, should be deleted to be replaced with the drawing sheets, consisting of Figs. 1-3, as shown on the attached page.

Signed and Sealed this

Thirteenth Day of April, 1993

*Attest:*

STEPHEN G. KUNIN

*Attesting Officer*

*Acting Commissioner of Patents and Trademarks*

United States Patent [19]

Kunze et al.

[11] Patent Number: 5,064,148

[45] Date of Patent: Nov. 12, 1991

[54] NAVIGABLE FLAT KITE

[76] Inventors: Christian Kunze, Wieteralles 33, 3410 Northeim; Till Habermann, Weenderlandstrasse 86, 3400 Göttingen, both of Fed. Rep. of Germany

[21] Appl. No.: 534,634

[22] Filed: Jun. 6, 1990

[30] Foreign Application Priority Data

Jun. 6, 1989 [DE] Fed. Rep. of Germany ... 8906900[U]
Mar. 7, 1990 [DE] Fed. Rep. of Germany ..... 4007159

[51] Int. Cl.[5] ..... B64C 31/06
[52] U.S. Cl. ..... 244/153 R; 244/155 A
[58] Field of Search ..... 244/153 A, 153 R, 155 A

[56] References Cited

U.S. PATENT DOCUMENTS

| | | | |
|---|---|---|---|
| 2,437,038 | 3/1948 | Nowka | 244/153 R |
| 3,074,673 | 1/1963 | Williams | 244/153 R |
| 3,296,617 | 1/1967 | Rogallo | 244/153 R X |
| 3,358,399 | 12/1967 | Waldmann | 244/153 R X |
| 3,409,255 | 11/1968 | Sada | 244/155 R |
| 3,967,798 | 7/1976 | Christoffel, Jr. | 244/153 R |
| 4,186,680 | 2/1980 | Harpole | 244/153 R X |
| 4,892,272 | 1/1990 | Hadzicki | 244/153 R |
| 4,958,787 | 9/1990 | Sterling | 244/153 R |

FOREIGN PATENT DOCUMENTS

| | | | |
|---|---|---|---|
| 3830459 | 3/1989 | Fed. Rep. of Germany | 244/153 R |

*Primary Examiner*—Joseph F. Peters, Jr.
*Assistant Examiner*—Carla Mattix
*Attorney, Agent, or Firm*—Herbert Dubno

[57] ABSTRACT

A navigable flat kite is described which has a linkage comprising cross bars and longitudinal bars, a sail mounted to the linkage and a balance mounted to the sail and/or the linkage and adapted to be connected with at least one navigation line. The kite consists of at least two individual kites which are connected by means of their cross bars such that the individual kites are adapted to be turned relative to one another around the cross bars as axis of rotation. The two individual kites have a sail surface with identical dimensions. Each individual kite is associated with at least one balance including at least one balance line which is mounted to the sail and/or the longitudinal bars above or below the cross bars.

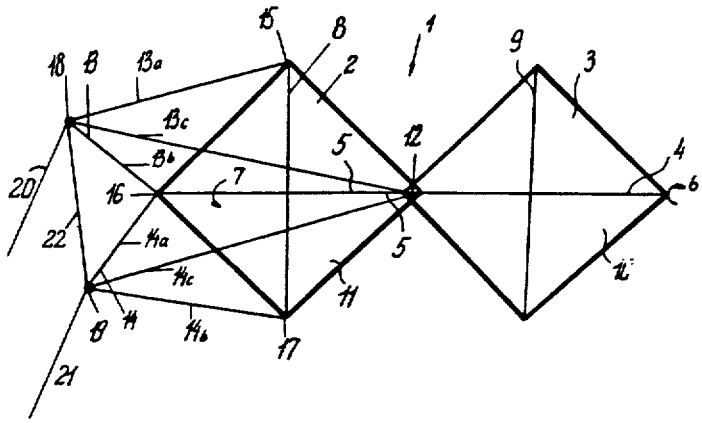

19 Claims, 1 Drawing Sheet